US008186005B2

(12) United States Patent
Stewen et al.

(10) Patent No.: US 8,186,005 B2
(45) **Date of Patent: *May 29, 2012**

(54) VACUUM CLEANING DEVICE

(75) Inventors: Christian Stewen, Marbach a.N. (DE); Uli Haeussermann, Fellbach (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 653 days.

This patent is subject to a terminal disclaimer.

(21) Appl. No.: 11/973,874

(22) Filed: Oct. 9, 2007

(65) Prior Publication Data

US 2008/0086835 A1 Apr. 17, 2008

Related U.S. Application Data

(63) Continuation of application No. PCT/EP2006/000672, filed on Jan. 26, 2006.

(30) Foreign Application Priority Data

Apr. 11, 2005 (DE) ..... 10 2005 017 568

(51) Int. Cl.
*A47L 9/10* (2006.01)

(52) U.S. Cl. ..... 15/347; 15/300.1; 15/326; 15/334; 15/352

(58) Field of Classification Search ..... 15/347, 15/300.1, 326, 334, 352; 251/334
See application file for complete search history.

(56) References Cited

U.S. PATENT DOCUMENTS 2,591,567 A * 4/1952 Lofgren et al. ..... 96/403
3,325,979 A 6/1967 Smith
3,363,764 A 1/1968 Whitaker
3,396,516 A 8/1968 Ballard
3,431,709 A 3/1969 Kawanami
3,498,030 A 3/1970 Wilki
3,509,394 A 4/1970 Heidtmann
3,536,094 A 10/1970 Manley, Jr.
3,731,465 A 5/1973 Ohira et al.
3,748,836 A 7/1973 Bachle (Continued)

FOREIGN PATENT DOCUMENTS

DE 210 658 6/1909

(Continued)

*Primary Examiner* — Robert Scruggs
(74) *Attorney, Agent, or Firm* — Lipsitz & McAllister, LLC

(57) ABSTRACT

The invention relates to a vacuum cleaning device comprising a dirt collection container which has a suction inlet and is in flow connection with at least one suction unit via at least one filter and at least one suction line, and comprising at least one external air inlet which opens into the suction line downstream of the at least one filter and is adapted to be closed by means of at least one closing valve, the closing valve having a movable valve body which, in a closed position, bears against at least one valve seat so as to form one or more sealing lines, the at least one sealing line delimiting an area which, in the closed position of the closing valve, is acted upon by a differential pressure. In order to develop the vacuum cleaning device in such a way that the at least one closing valve is of structurally simple design and the at least one filter can be completely cleaned within a short period of time, the invention proposes that the square of the total length of all sealing lines is at least 25 times the total size of all areas which are delimited by the sealing lines and acted upon by a differential pressure.

27 Claims, 4 Drawing Sheets

U.S. PATENT DOCUMENTS

| | | | | | |
|---|---|---|---|---|---|
| 3,792,569 | A | | 2/1974 | Carlson et al. | |
| 3,868,237 | A | | 2/1975 | Berz | |
| 3,945,390 | A | | 3/1976 | Huber | |
| 3,951,623 | A | | 4/1976 | Furstenberg | |
| 3,994,067 | A | | 11/1976 | Hazzard et al. | |
| 4,033,732 | A | * | 7/1977 | Axelsson et al. | 95/280 |
| 4,124,915 | A | | 11/1978 | Schlicher | |
| 4,124,916 | A | * | 11/1978 | Fromknecht | 15/339 |
| 4,171,208 | A | | 10/1979 | Lowder | |
| 4,277,265 | A | * | 7/1981 | Leinfelt | 55/302 |
| 4,329,161 | A | * | 5/1982 | Osborn | 95/280 |
| RE31,417 | E | * | 10/1983 | Huber | 137/1 |
| 4,482,129 | A | * | 11/1984 | Baker et al. | 251/334 |
| 4,581,135 | A | | 4/1986 | Gerulis | |
| 4,719,662 | A | | 1/1988 | Horak et al. | |
| 4,733,326 | A | | 3/1988 | Harsch et al. | |
| 4,921,510 | A | | 5/1990 | Plooy | |
| 5,002,594 | A | | 3/1991 | Merritt | |
| 5,178,652 | A | | 1/1993 | Hüttlin | |
| 5,217,509 | A | | 6/1993 | Jansen | |
| 5,246,205 | A | | 9/1993 | Gillingham et al. | |
| 5,322,534 | A | | 6/1994 | Kaiser | |
| 5,368,060 | A | * | 11/1994 | Worrall et al. | 137/15.18 |
| 5,369,839 | A | * | 12/1994 | Worwag | 15/327.6 |
| 5,511,583 | A | | 4/1996 | Bassett | |
| 5,882,180 | A | | 3/1999 | Kawaguchi et al. | |
| 5,951,746 | A | | 9/1999 | Treitz et al. | |
| 5,975,062 | A | | 11/1999 | Bonse et al. | |
| 6,406,505 | B1 | | 6/2002 | Oh et al. | |
| 6,440,191 | B1 | | 8/2002 | Berfield et al. | |
| 6,458,178 | B1 | | 10/2002 | Dietz et al. | |
| 6,517,325 | B2 | | 2/2003 | Tsuru et al. | |
| 6,640,385 | B2 | | 11/2003 | Oh et al. | |
| 6,782,583 | B2 | | 8/2004 | Oh | |
| 6,936,161 | B2 | * | 8/2005 | Wright et al. | 210/97 |
| 7,082,640 | B2 | | 8/2006 | McCutchen | |
| 7,340,797 | B2 | | 3/2008 | Theiss, Jr. et al. | |
| 7,647,672 | B2 | | 1/2010 | Nam et al. | |
| 7,861,367 | B2 | | 1/2011 | Eckstein et al. | |
| 7,867,304 | B2 | | 1/2011 | Stewen et al. | |
| 7,947,099 | B2 | | 5/2011 | Valentini | |
| 7,976,614 | B2 | | 7/2011 | Eckstein et al. | |
| 8,015,660 | B2 | | 9/2011 | Bruntner | |
| 2002/0066262 | A1 | | 6/2002 | Oh | |
| 2002/0088078 | A1 | | 7/2002 | Oh et al. | |
| 2002/0124729 | A1 | | 9/2002 | Dudley | |
| 2003/0041729 | A1 | | 3/2003 | Finigan | |
| 2003/0167590 | A1 | | 9/2003 | Oh | |
| 2005/0011036 | A1 | | 1/2005 | McCutchen | |
| 2005/0251953 | A1 | | 11/2005 | Hackwell et al. | |
| 2005/0254270 | A1 | | 11/2005 | Melchert et al. | |
| 2008/0092498 | A1 | * | 4/2008 | Stewen et al. | 55/283 |
| 2009/0000485 | A1 | | 1/2009 | Valentini | |
| 2009/0027823 | A1 | | 1/2009 | Follic et al. | |
| 2009/0106933 | A1 | | 4/2009 | Bruntner | |
| 2009/0205159 | A1 | * | 8/2009 | Stewen et al. | 15/347 |

FOREIGN PATENT DOCUMENTS

| | | | |
|---|---|---|---|
| DE | 276953 | | 7/1914 |
| DE | 338942 | | 7/1921 |
| DE | 1 844 732 | | 1/1962 |
| DE | 1 245 550 | | 7/1967 |
| DE | 1 407 945 | | 11/1968 |
| DE | 1 800 480 | | 6/1970 |
| DE | 2 102 231 | | 7/1971 |
| DE | 2 106 058 | | 9/1971 |
| DE | 2 416 071 | | 10/1974 |
| DE | 91 04 127 | | 7/1991 |
| DE | 41 38 223 | | 2/1993 |
| DE | 197 01 983 | | 6/1998 |
| DE | 298 23 411 | | 5/1999 |
| DE | 199 49 095 | | 4/2001 |
| DE | 200 10 608 | | 12/2001 |
| DE | 100 56 935 | | 2/2002 |
| DE | 101 40 351 | | 6/2002 |
| DE | 101 01 219 | | 7/2002 |
| DE | 101 50 257 | | 7/2002 |
| DE | 102 40 618 | | 9/2003 |
| DE | 695 30 326 | | 5/2004 |
| DE | 20 2004 012 911 | | 11/2004 |
| DE | 10 2005 029 606 | | 1/2006 |
| DE | 10 2004 056 076 | | 5/2006 |
| DE | 10 2005 017 702 | | 12/2006 |
| DE | 10 2005 035 884 | | 2/2007 |
| DE | 20 2007 015 242 | | 1/2008 |
| EP | 0 197 036 | | 10/1986 |
| EP | 0 289 987 | | 11/1988 |
| EP | 0 873 075 | | 10/1998 |
| EP | 0955003 | * | 11/1999 |
| EP | 955003 A1 | * | 11/1999 |
| EP | 1 166 705 | | 1/2002 |
| EP | 1 340 446 | | 9/2003 |
| EP | 1 656 872 | | 5/2006 |
| EP | 1 743 562 | | 1/2007 |
| EP | 1 913 857 | | 4/2008 |
| EP | 1 997 415 | | 12/2008 |
| GB | 956764 | | 4/1964 |
| GB | 2 337 922 | | 12/1999 |
| JP | 08038401 | | 2/1996 |
| JP | 2002028107 | | 1/2002 |
| JP | 2006181228 | | 7/2006 |
| SU | 644513 | | 1/1979 |
| WO | 85/02528 | | 6/1985 |
| WO | 95/10972 | | 4/1995 |
| WO | 95/27431 | | 10/1995 |
| WO | 97/19630 | | 6/1997 |
| WO | 01/74493 | | 10/2001 |
| WO | 2004/100752 | | 11/2004 |
| WO | 2005/006934 | | 1/2005 |
| WO | 2006/108459 | | 10/2006 |

* cited by examiner

VACUUM CLEANING DEVICE

This application is a continuation of international application number PCT/EP2006/000672 filed on Jan. 26, 2006.

The present disclosure relates to the subject matter disclosed in international application number PCT/EP2006/000672 of Jan. 26, 2006 and German application number 10 2005 017 568.6 of Apr. 11, 2005, which are incorporated herein by reference in their entirety and for all purposes.

BACKGROUND OF THE INVENTION

The invention relates to a vacuum cleaning device comprising a dirt collection container which has a suction inlet and is in flow connection with at least one suction unit via at least one filter and at least one suction line, and comprising at least one external air inlet which opens into the at least one suction line downstream of the at least one filter and is adapted to be closed by means of at least one closing valve, the at least one closing valve having a movable valve body which, in a closed position, bears against at least one valve seat so as to form one or more sealing lines, the at least one sealing line delimiting an area which, in the closed position of the closing valve, is acted upon by a differential pressure.

Vacuum cleaning devices of this type may be designed, for example, as vacuum cleaners or else as suction sweepers. They have a dirt collection container which is adapted to be acted upon by negative pressure from one or more suction units, so that a suction stream forms and dirt is sucked into the dirt collection container under the influence of said suction stream. The dirt collection container is in flow connection with the suction unit via at least one filter and at least one suction line which follows said filter. The at least one filter permits solids, that is to say particles of dirt and dust for example, to be separated out of the suction stream. During operation of the vacuum cleaning device, more and more solids accumulate at the filter, so that the filter constitutes an increasing resistance to flow and therefore has to be cleaned. To this end, the at least one filter is adapted to be acted upon by external air, which can flow into the suction line via the external air inlet downstream of the filter, against the direction of flow which forms during suction operation. The external air used may be, for example, ambient air or else pressurized air which is pressurized by the vacuum cleaning device or stored under pressure in a storage container. During suction operation, the external air inlet is tightly closed by the at least one closing valve which is opened for filter cleaning purposes. The at least one closing valve has a movable valve body which bears in sealing manner against at least one associated valve seat during the suction operation, at least one sealing line being formed between the valve seat and the valve body and the external air inlet being tightly closed along said sealing line. The at least one sealing line delimits an area which is acted upon by a differential pressure in the closed position of the at least one closing valve.

Vacuum cleaning devices of this type are known, for example, from DE 298 23 411 U1 which proposes, for filter cleaning purposes, closing the suction inlet so that a strong negative pressure forms in the dirt collection container. A closing valve should then be opened and a filter cleaned as a result. Effective cleaning can thus be achieved but suction operation has to be completely interrupted to this end. In order to counteract this disadvantage, DE 199 49 095 A1 proposes cleaning only a subregion of the filter in each case, so that suction operation can be maintained by means of another subregion. Individual subregions of the filter are therefore cleaned one after the other, without suction operation having to be interrupted. However, the supply of external air in each case only to a subregion of the filter requires a closing valve mechanism of complicated design.

It is an object of the present invention to develop a vacuum cleaning device of the type mentioned in the introduction in such a way that the at least one closing valve is of structurally simple design and the at least one filter can be completely cleaned within a short time.

SUMMARY OF THE INVENTION

According to the invention, this object is achieved in the case of a vacuum cleaning device of this generic type in that the square of the total length of all sealing lines is at least 25 times the total size of all areas which are delimited by the sealing lines and acted upon by a differential pressure.

The invention incorporates the idea that, by providing one or more sealing lines which are as long as possible but which delimit as small an area as possible, a strong, abruptly occurring external air stream can be provided within a very short time when the valve body is lifted away from the valve seat, so that the negative pressure abruptly drops on that side of the at least one filter which faces away from the dirt collection container, and external air flows through the filter in the countercurrent direction. The abrupt increase in pressure results in the filter being mechanically shaken and cleaned, it being possible for cleaning to be performed within a very short time. The total length of all sealing lines is selected to be considerably greater than the circumference of a circular area whose area corresponds to the area of the surface delimited by the sealing lines. The ratio between the square of the total length of all sealing lines and the size of the area delimited as a whole by the sealing lines is, according to the invention, at least 25 and is therefore at least twice the size as in the case of only one sealing line which surrounds a closed circular area whose circumference is defined by the sealing line. In the case of a circular area, the ratio of the square of the length of the sealing line to the size of the circular area has a value of approximately 12.5, specifically four times the number $\pi$ (3.14).

The area which is delimited by the at least one sealing line is designated that area which is acted upon by the differential pressure which forms across the closing valve in the closed position of the closing valve. This area is delimited by the at least one sealing line, and provision is made, according to the invention, for the area which is acted upon by the differential pressure to be selected to be as small as possible when a sealing line which is as long as possible is provided. Since the area which is acted upon by the differential pressure determines the force with which the closing valve is acted upon in its closed position, the provision of an area which is as small as possible can reduce the mechanical load on the closing valve. This in turn has the result that the closing valve can have a small overall size, and nevertheless a strong external air stream can be provided by way of the at least one sealing line, which is selected to be as long as possible, when opening the closing valve, for cleaning the filter.

It is particularly advantageous if the square of the total length of all sealing lines is at least 50 times, preferably more than 100 times, the total size of all areas which are delimited by the sealing lines. Therefore, a very long line is provided and the external air inlet is sealed along said line. When the closing valve is opened, external air can be supplied to the filter via this sealing line. This makes it possible for effective filter cleaning to be achieved even when the closing valve is opened very briefly. For filter cleaning purposes, it is therefore necessary for the suction operation to be interrupted only for fractions of a second. This has the result that there is virtually no interruption in the suction stream at the free end of a suction hose which is connected to the suction inlet, and therefore virtually continuous suction operation can be maintained with an approximately constant suction power, that is to say with an approximately constant suction volume flow. The vacuum cleaning device according to the invention is therefore distinguished by high efficiency.

The at least one closing valve can have a single sealing line, for example a sealing line which is configured in a star-shape or in the form of the edge of a clover leaf and has an alternating positive and negative curvature.

It has proven particularly advantageous if the at least one closing valve has a plurality of sealing lines in the form of closed sealing sections. Therefore, for example, two sealing sections can be used which define an outer edge and an inner edge of an area which is acted upon by the differential pressure.

The closed sealing sections can be disposed next to one another. However, the sealing sections preferably form sealing rings which are situated one within the other. The sealing rings are preferably disposed concentrically in relation to one another. For example, four sealing rings can be used which are disposed concentrically in relation to one another, in each case two sealing rings delimiting an annular area which is acted upon by the differential pressure. In this case, the area which is delimited overall by the sealing lines is given by the sum of the two ring areas.

The sealing rings can have a uniform spacing in relation to one another over their entire circumference, but provision may also be made for individual sealing rings to touch.

The sealing sections are preferably round and form, for example, an oval or circle.

If only one sealing line is used, this sealing line is preferably disposed in one plane. However, if a plurality of sealing lines are used, provision may also be made for the individual sealing lines to be disposed in different planes, for example in planes which are offset or inclined in relation to one another.

In a refinement of the at least one closing valve which is particularly simple in terms of design and not susceptible to faults, the valve body has a valve disk which, with the interposition of at least one sealing element which defines a sealing line, is adapted to be engaged sealingly against the at least one valve seat. The valve disk can be very flat, so that the closing valve requires only a small installation space.

It is advantageous if the valve disk has at least one, preferably annular, passage opening which is delimited by one or more sealing elements in the closed position of the valve disk. A configuration of this type has the advantage that, when the valve disk is lifted away from the valve seat, external air can firstly flow into the suction line laterally beside the valve disk but secondly also through the at least one passage opening in the valve disk. A strong external air stream can be achieved even when the valve disk is only slightly lifted away from the valve seat. This not only has the advantage that only a small clearance for movement has to be guaranteed for the valve disk, but furthermore has the advantage that even a very brief opening movement is sufficient for external air to act abruptly on the at least one filter and thus to achieve effective cleaning.

In a particularly advantageous embodiment, the at least one valve seat has a plurality of through openings which are each delimited by at least one sealing element in the closed position of the valve disk. Provision may be made, for example, for the at least one valve seat to comprise two annular through openings which are disposed concentrically in relation to one another and via which external air can flow into the suction line when the valve disk is lifted away from the valve seat.

The valve body can be pivotably mounted on the at least one valve seat or on a part which is fixed to the device. However, it is particularly advantageous if the valve body is displaceably mounted, in particular provision can be made for the valve body to be displaceably mounted in a guide.

In an advantageous embodiment, the guide is cylindrical, since this provides the option of rotating the valve body about the cylinder axis of the guide without the opening and closing movement of the valve body being adversely affected as a result. The provision of a cylindrical guide therefore reduces the risk of the valve body tilting.

Provision may be made for the at least one closing valve to have a guide sleeve which enters a guide receptacle. The guide sleeve can be disposed on the valve body; the guide sleeve is preferably integrally connected to the valve body.

It is expedient if the valve body is subjected to a closing force by a spring. The spring moves the valve body, which is lifted away from the valve seat when the closing valve is opened, back to its closed position as soon as the negative pressure in the suction line downstream of the at least one filter is reduced by virtue of the action of the suction unit. The suction unit is in flow connection with the at least one filter, specifically also during the filter cleaning operation, so that the external air which flows into the suction line via the closing valve and briefly acts on the filter in the countercurrent direction is sucked away by the suction unit. In the closed position, the spring ensures reliable fixing of the valve body. When the closing valve is opened, the spring absorbs the energy of the valve body, decelerates said valve body and accelerates it back to its closed position again.

The spring can be of multi-part, in particular two-part, configuration, it being possible for a relatively long spring part to have a smaller spring constant than a shorter spring part. The shorter spring part with the higher spring constant delimits the opening travel of the valve body and therefore also the quantity of external air entering.

As an alternative, provision may be made for a single spring which preferably has a non-linear characteristic to be used, so that the movement of the valve body at the beginning is only slightly and then more strongly impeded. As a result, a very strong pressure surge can be achieved when the closing valve is opened, by means of which pressure surge the at least one filter can be cleaned in an extremely short time.

As an alternative or in addition to the spring, provision may be made for the valve body to be held in the closed position by a magnetic holder. To this end, at least one permanent magnet can be used, for example, which permanent magnet reliably holds the valve body in its closed position when there are pressure differences as are produced at the at least one closing valve during proper suction operation. If the pressure difference is increased for filter cleaning purposes, the magnetic holder releases the valve body, which then lifts away from the valve seat, so that external air can flow in. The pressure difference can, for example, be increased by the negative pressure within the dirt collection container being increased, for example by closing the suction inlet or a suction hose which is connected to said suction inlet. As an alternative or in addition, the pressure difference can be increased by external air at an overpressure being supplied to the at least one closing valve. For this purpose, the vacuum cleaning device can have a pressure reservoir which is filled by a compressor. If external air is released from the pressure reservoir, the overpressure which is formed exerts an increased force, which can no longer be compensated by the magnetic holder, on the valve body in the opening direction, so that the at least one closing valve opens. If the supply of pressurized external air is interrupted, the overpressure then decreases and the valve body returns to its closed position under the action of the magnetic force, possibly assisted by the action of a closing spring.

It is particularly advantageous if the magnetic holder comprises an electromagnet. This permits the magnetic holder to be electrically actuated in such a way that the closing valve maintains its closed position for as long as the electromagnet is supplied with power. If the supply of power is interrupted, the closing valve abruptly opens.

It has proven particularly advantageous to configure the electromagnet as a holding solenoid. Holding solenoids of this type are distinguished by a very low magnetic remanence, so that there is virtually no residual magnetic field remaining when the supply of power is interrupted and the valve body can therefore be lifted away from the valve seat in a very short time.

Provision may be made for the at least one closing valve to be mechanically operated. However, it is advantageous if it is adapted to be electronically operated. Therefore, provision may be made, for example, for the pressure difference which is formed across the filter to be detected by means of pressure sensors. The greater the pressure difference, the greater the resistance to flow of the filter, and the at least one closing valve can be operated by means of control electronics when a predetermined value for the pressure difference is exceeded.

Time-controlled operation of the at least one closing valve is advantageous. In this case, provision may be made for said closing valve to be operated at different time intervals. In particular, further operation can be performed only after a relatively long time interval following a plurality of relatively short time intervals. However, effective filter cleaning can also be achieved when the filter is cleaned at constant time intervals.

The at least one filter is preferably configured as a folded filter, for example in the form of a filter cartridge or a flat folded filter.

The vacuum cleaning device can have a plurality of filters, but it has proven particularly advantageous if the vacuum cleaning device comprises a single filter. In particular, provision may be made for the filter to be acted upon by external air over its entire surface by simultaneously opening all closing valves.

As explained above, the inventive refinement of the vacuum cleaning device permits the negative pressure in the suction line to abruptly increase in that region which is adjacent to the at least one filter, and the negative pressure is then again reduced within a very short time by virtue of the action of the at least one suction unit. When the at least one closing valve is opened, the valve body can briefly remain in an open position, and then return to its closed position. However, it is particularly advantageous if the valve body, starting from its closed position, can continuously move back to its closed position via its open position. In a refinement of this type, the valve body executes a continuous movement when the closing valve is opened, without said valve body remaining in its open position. When the closing valve is opened, the valve body is powerfully accelerated and then decelerated again, so that it reverses its movement direction and then assumes its closed position again. The entire movement of the valve body, starting from its closed position, via the open position and back to the closed position, can take place in fractions of a second in this case.

In a particularly preferred embodiment, the at least one filter is adapted to be acted upon by external air for less than 200 ms, in particular for less than 100 ms, by means of the closing valve. An action of this type does not lead to a noticeable interruption in suction operation for the user, but, on account of the provision of a very long sealing line for the at least one closing valve, results in effective cleaning of the filter.

The at least one filter can preferably be acted upon by external air by means of the at least one closing valve while maintaining a negative pressure in the mouth region of a suction hose which opens into the suction inlet. If the at least one closing valve is opened, the pressure on that side of the filter which faces away from the dirt collection container abruptly increases and is then reduced again. The abrupt increase in pressure effects effective cleaning of the filter but since it is immediately reduced again by the at least one suction turbine it does not lead to a complete interruption in the negative pressure in the mouth region of the suction hose which opens into the suction inlet. Instead, virtually continuous suction operation can be maintained.

By way of example, provision may be made, when a 2.5 m-long suction hose with an inside diameter of 35 mm is connected while the at least one filter is acted upon by external air, for the negative pressure in the suction hose at a distance of 3 cm from the suction inlet to fall, at most for 150 ms, below 40% of the value which forms when closing valves are closed. A standard hose with an inside diameter of 35 mm and a length of 2.5 m is usually connected to the vacuum cleaning device according to the invention. During suction operation, a negative pressure which can be, for example, approximately 50 mbar in the suction hose at a distance of 3 cm from the suction inlet, forms in the suction hose and in the dirt collection container if no tool is connected to the free end of the suction hose, said free end of the suction hose thus being open. If the at least one closing valve is briefly opened for filter cleaning purposes, the negative pressure at the designated point briefly drops to a value of less than 20 mbar, but at the latest after 150 ms, the negative pressure again exceeds the value of 20 mbar and again approaches the original value of 50 mbar. There is therefore no noticeable interruption in suction operation for the user. Provision may be made, for example, for the negative pressure at the designated point to drop below a value of 40% of the value which forms when closing valves are closed for less than 100 ms, in particular for approximately 50 to approximately 80 ms.

The following description of a preferred embodiment of the invention serves to explain the invention in greater detail in conjunction with the drawings.

DETAILED DESCRIPTION OF THE INVENTION

Figure 1:
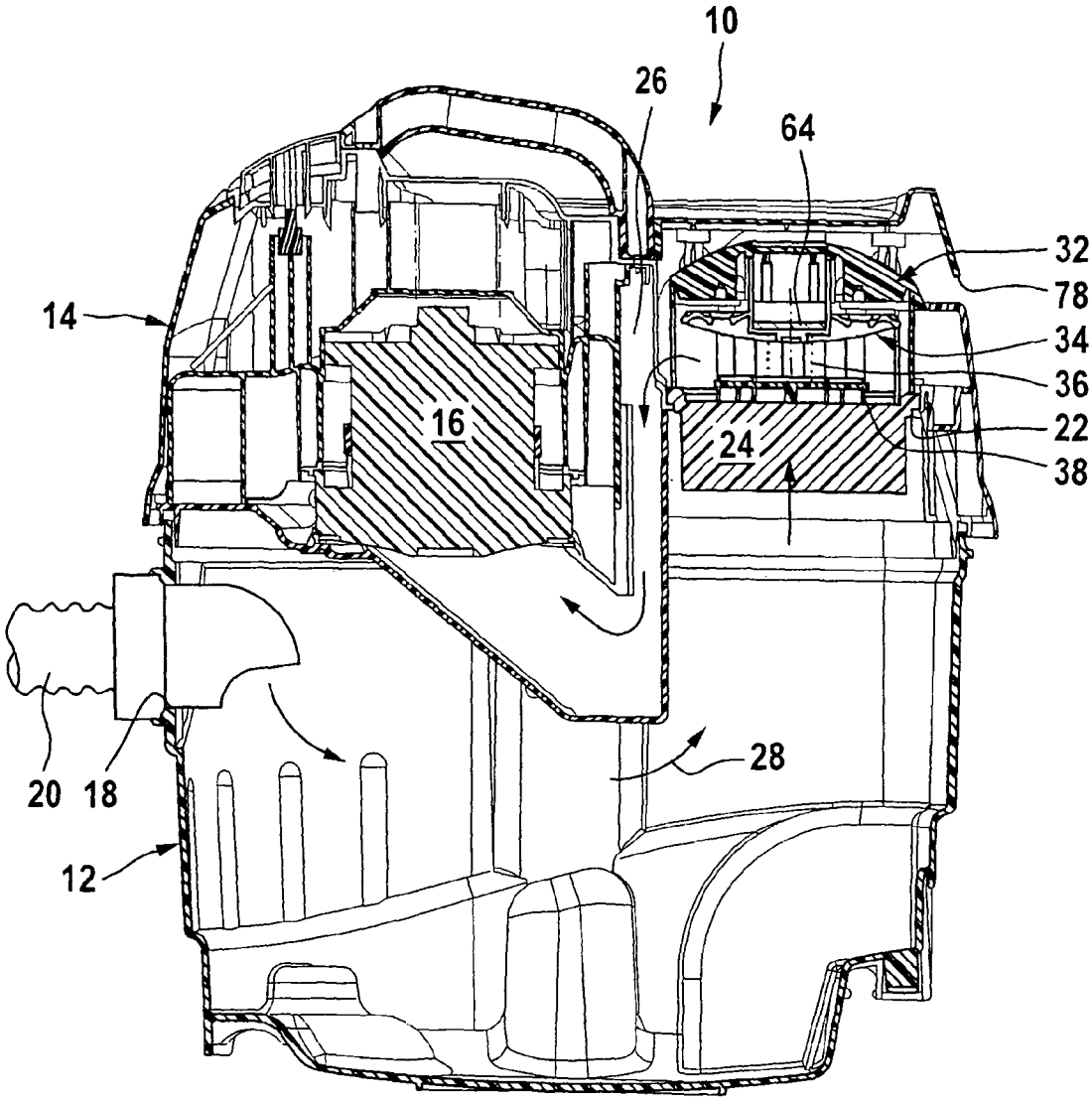
FIG. 1: shows a schematic sectional view of a vacuum cleaning device according to the invention.

In the drawing, there is schematically illustrated a vacuum cleaning device in the form of a vacuum cleaner 10, comprising a lower part which forms a dirt collection container 12 and on which an upper part 14 which accommodates a suction unit 16 is fitted. The dirt collection container 12 has a volume of up to 80 l, preferably a volume of approximately 30 l to approximately 80 l. It comprises a suction inlet 18 to which a suction hose 20 can be connected at whose free end (not illustrated in the drawing in order to provide a better overview) a suction nozzle can be connected. As an alternative, provision may be made for the suction hose 20 to be connected to a working tool, for example a drilling unit or a milling unit, so that dust produced during operation of the working tool can be sucked away.

The upper part 14 forms a suction outlet 22 for the dirt collection container 12, a folded filter 24 being mounted at the suction outlet 22 and having connected to it a suction line in the form of a suction channel 26 via which the folded filter 24 is in flow connection with the suction unit 16. The dirt collection container 12 can be acted upon by negative pressure from the suction unit 16 via the suction channel 26 and the folded filter 24, so that a suction stream which is symbolized by the arrows 28 in FIG. 1 is formed and dirt can be sucked into the dirt collection container 12 under the action of said suction stream. The dirt particles can be separated out of the suction stream 28 by means of the folded filter 24.

Figure 2:
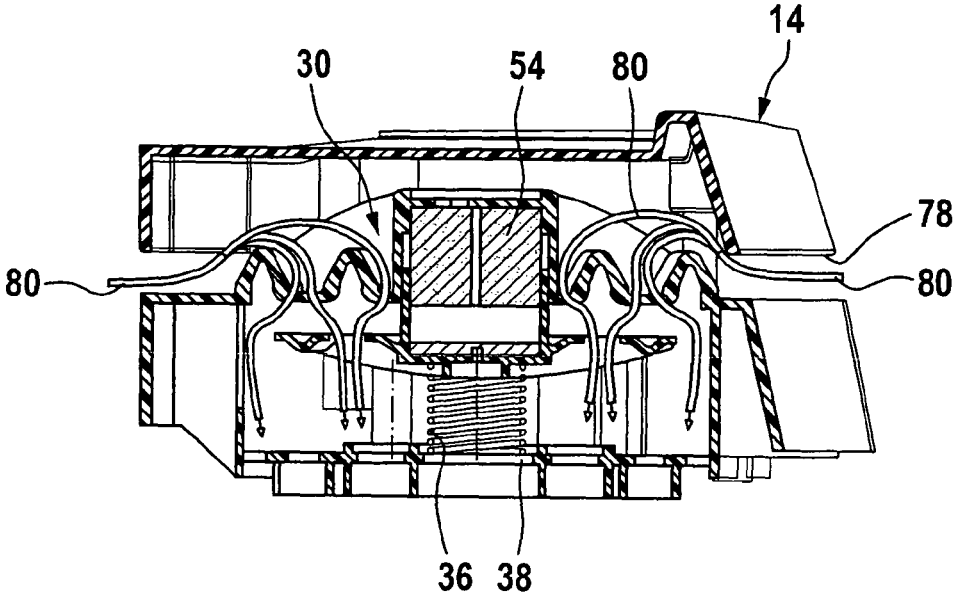
FIG. 2: shows an enlarged sectional view of the vacuum cleaning device from FIG. 1 in the region of a closing valve.

A closing valve 30, which is illustrated in an enlarged manner in FIG. 2, is disposed above the folded filter 24 in the upper part 14. Said closing valve comprises a valve holder 32 which is disposed in the upper part 14 in a locationally fixed manner, forms a valve seat and interacts with a valve body in the form of a valve disk 34. The valve disk 34 is subjected to a closing force in the direction of the valve holder 32 by means of a closing spring 36 with a non-linear characteristic. The closing spring 36 is clamped between a plate-like filter holder 38, which is disposed in the upper part 14 in a locationally fixed manner, and the valve disk 34.

Figure 3:
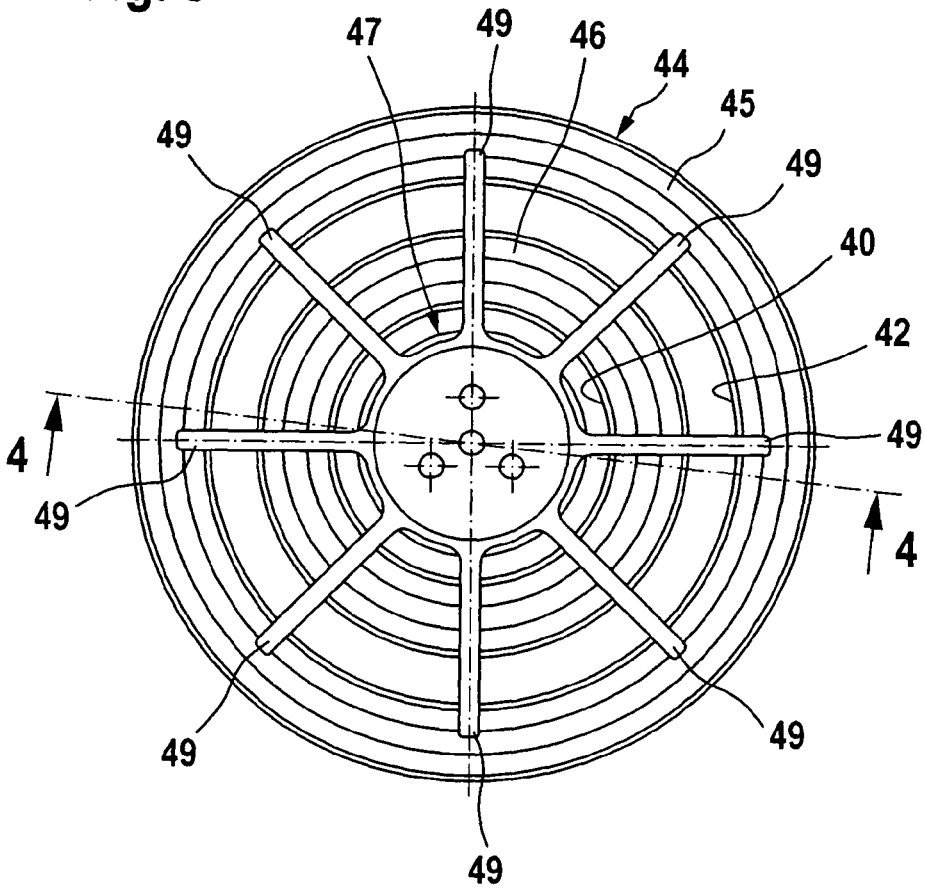
FIG. 3: shows a plan view of a detail of a valve holder of the closing valve.
Figure 4:
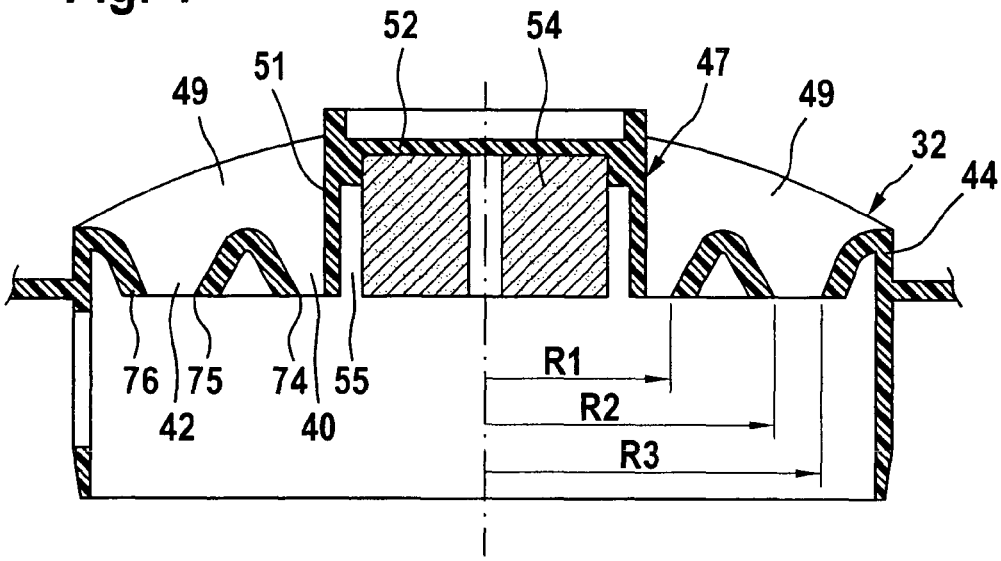
FIG. 4: shows a sectional view along line 4-4 in FIG. 3.
Figure 5:
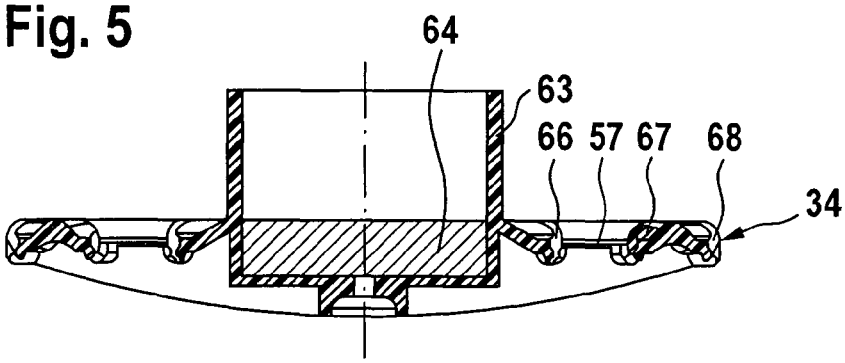
FIG. 5: shows a sectional view of a valve body of the closing valve.
Figure 6:
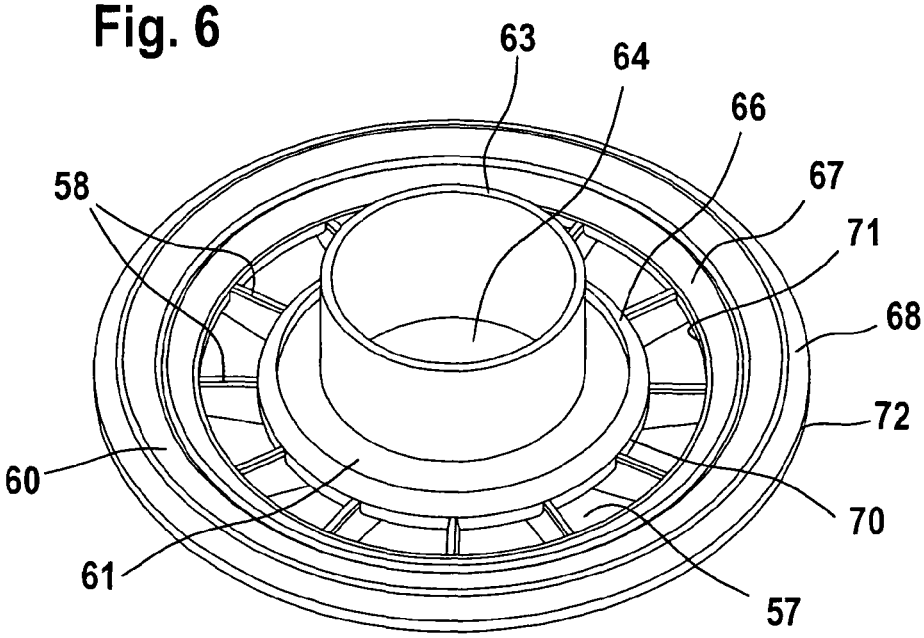
FIG. 6: shows a pictorial representation of the valve body from FIG. 5.

As shown in particular in FIGS. 3 and 4, the valve holder 32 has two annular through openings 40, 42 which are disposed concentrically in relation to one another and are tightly closed by the valve disk 34 in the closed position of the closing valve 30. The through openings 40 and 42 are formed in a holding disk 44 of the valve holder 32, the holding disk 44 being divided by the through openings 40 and 42 into an outer ring 45 and an inner ring 46, which rings concentrically surround a cylindrical center part 47 and are fixed on the center part 47 by means of holding ribs 49 which protrude from the outside of the center part 47 in a radial direction.

The center part 47 comprises a hollow-cylindrical shell 51 which is covered at the top by an end wall 52 and accommodates a holding solenoid 54. Said holding solenoid 54 is surrounded by an annular space 55 within the center part 47 and is electrically connected to a control unit (not illustrated in the drawing) of the vacuum cleaner 10 via connecting cables (likewise not illustrated in the drawing).

The valve disk 34 has an annular passage opening 57 through which a multiplicity of radially directed supporting ribs 58 pass and which connect an outer ring region 60 of the valve disk 34 to a circular central region 61 of the valve disk 34. A guide sleeve 63 protrudes upward from the central region 61 in the direction of the center part 47 of the valve holder 32, enters the annular space 55 in the valve holder 32 and accommodates an iron plate 64, which is adhesively bonded into the guide sleeve 63.

On its upper side which faces the valve holder 32, the valve disk 34 carries an inner sealing ring 66, a middle sealing ring 67 and an outer sealing ring 68, which rings are oriented concentrically in relation to one another and each form a sealing lip. The inner sealing ring 66 runs along an inner edge 70 of the passage opening 57, the middle sealing ring 67 runs along an outer edge 71 of the passage opening 57 and the outer sealing ring 68 runs along the outer periphery 72 of the valve disk 34.

In the closed position of the valve disk 34, the inner sealing ring 66 bears in a sealing manner against the outer edge 74 of the through opening 40 of the valve holder 32, and the middle sealing ring 67 and the outer sealing ring 68 bear in a sealing manner against an inner edge 75 and, respectively, an outer edge 76 of the through opening 42. The sealing rings 66, 67 and 68 therefore define annular sealing lines which delimit an area which is acted upon by the pressure difference which forms at the closing valve 30. In this case, the inner sealing ring 66 delimits a first, circular partial area with a radius R1, and the sealing rings 67 and 68 delimit a second, annular partial area with an inside radius R2 and an outside radius R3. Overall, the closing valve 30 therefore has a sealing line which is defined by the sealing rings 66, 67 and 68 and whose length is given by the sum of the lengths of the sealing rings 66, 67 and 68. The sealing line formed in this way delimits an area which is acted upon by the pressure difference which forms at the closing valve 30 and is given by the sum of the described first and second partial areas. The square of the total length of the sealing line is considerably greater than 25 times the area delimited by the sealing line. Compared with a circular area whose circumference corresponds to the total length of the sealing line, the area actually delimited by the sealing line is significantly smaller than 50% of the circular area. This has the result that an intensive external air stream can form when the closing valve 30 is opened, on account of which the negative pressure in the region between the folded filter 24 and the closing valve 30 falls abruptly, so that the folded filter 24 is subjected to a pressure surge, and external air, which can flow into the upper part 14 via a lateral opening 78, briefly flows through the filter against the suction stream 28, that is to say in the countercurrent direction. The external air stream is illustrated by the arrows 80 in FIG. 2.

Figure 7:
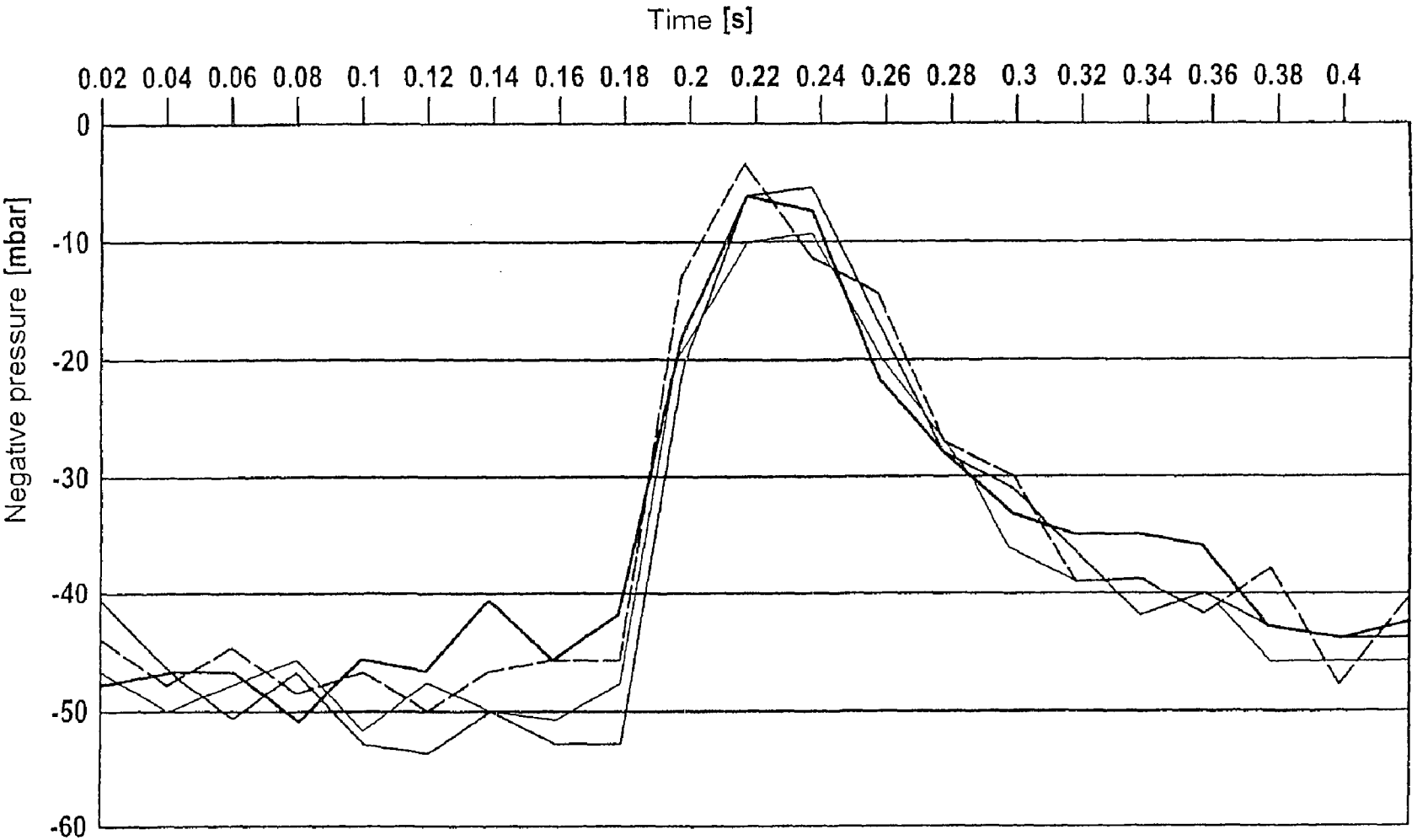
FIG. 7: shows the variation in the negative pressure which forms, when the closing valve is operated, in the mouth region of a suction hose which is connected to the vacuum cleaning device.

If the closing valve 30 assumes its closed position, a negative pressure forms in the dirt collection container 12 and in the suction channel 26. If a suction hose with a length of 2.5 m and an inside diameter of 35 mm is connected to the suction inlet 18, the negative pressure in the mouth region of the suction tube, specifically at a distance of 3 cm from the suction inlet 18, is approximately 50 mbar, provided that no tool or suction nozzle is connected to the free end of the suction hose. FIG. 7 shows the variation in corresponding pressure measurements. If the supply of power to the holding solenoid 54 is interrupted for operation of the closing valve 30, the magnetic force with which the iron plate 64 is held on the holding solenoid is abruptly cut off. This results in the valve disk 34 being lifted away from the valve holder 32 against the closing force of the closing spring 36 under the action of the pressure difference which prevails at the closing valve 30. The closing spring 36 absorbs the energy of the valve disk 34, decelerates said valve disk and then accelerates it back again, so that it assumes its closed position again within a short time and closes the through openings 40 and 42 in the valve holder 32 again. The external air stream 80 is formed during the movement of the valve disk 34, so that external air flows into the dirt collection container 12 through the folded filter 24 in the countercurrent direction and the negative pressure in the mouth region of the suction hose 20 falls within approximately 40 to about 60 ms. However, since the valve disk 34 has then already assumed its closed position again and the external air which has flowed in is sucked away by the suction unit 16, the negative pressure then increases again, so as to virtually assume its original value of about 50 mbar after approximately 200 ms. Values below 40% of the value which forms when the closing valve 30 is closed, that is to say values of less than 20 mbar, are assumed by the negative pressure in the mouth region of the suction hose 20 only for a time period of about 60 ms. This results in virtually continuous suction operation being maintained for the user and reliable filter cleaning nevertheless being ensured. In this case, the closing valve has a compact configuration with a small structural shape, and can be produced in a cost-effective manner.

The invention claimed is:

1. Vacuum cleaning device comprising:

a dirt collection container which has a suction inlet and is in flow connection with at least one suction unit via at least one filter and at least one suction line, and at least one external air inlet which opens into the at least one suction line downstream of the at least one filter and which is adapted to be closed by means of at least one closing valve, the at least one closing valve having a movable valve body which, in a closed position, bears against at least one valve seat so as to form at least one sealing line, the at least one sealing line delimiting an area which, in the closed position of the closing valve, is acted upon by a differential pressure, wherein a square of a total length of all sealing lines is at least 25 times a total size of all areas which are delimited by the sealing lines and acted upon by differential pressure.

2. Vacuum cleaning device according to claim 1, wherein the square of the total length of all sealing lines is at least 50 times the total size of all areas which are delimited by the sealing lines.

3. Vacuum cleaning device according to claim 1, wherein the at least one closing valve has a plurality of sealing lines in the form of closed sealing sections.

4. Vacuum cleaning device according to claim 3, wherein the sealing sections form sealing rings which are situated one within the other.

5. Vacuum cleaning device according to claim 4, wherein the sealing rings are disposed concentrically in relation to one another.

6. Vacuum cleaning device according to claim 4, wherein the sealing rings are round.

7. Vacuum cleaning device according to claim 3, wherein the sealing sections are disposed in a common plane.

8. Vacuum cleaning device according to claim 1, wherein the valve body has a valve disk which, with the interposition of at least one sealing element which defines a sealing line, is adapted to be engaged sealingly against the at least one valve seat.

9. Vacuum cleaning device according to claim 8, wherein the valve disk has at least one passage opening which is delimited by the at least one sealing element in the closed position of the valve body.

10. Vacuum cleaning device according to claim 8, wherein the at least one valve seat has a plurality of through openings which are each delimited by the at least one sealing element in the closed position of the valve body.

11. Vacuum cleaning device according to claim 1, wherein the valve body is displaceably mounted in a guide.

12. Vacuum cleaning device according to claim 11, wherein the guide is cylindrical.

13. Vacuum cleaning device according to claim 1, wherein the at least one closing valve has a guide sleeve which enters a guide receptacle.

14. Vacuum cleaning device according to claim 1, wherein the valve body is subjected to a closing force by a spring.

15. Vacuum cleaning device according to claim 14, wherein the spring has a non-linear characteristic.

16. Vacuum cleaning device according to claim 1, wherein the valve body is held in the closed position by a magnetic holder.

17. Vacuum cleaning device according to claim 16, wherein the magnetic holder comprises an electromagnet.

18. Vacuum cleaning device according to claim 17, wherein the electromagnet is configured as a holding solenoid.

19. Vacuum cleaning device according to claim 1, wherein the at least one closing valve is adapted to be electronically operated.

20. Vacuum cleaning device according to claim 19, wherein the at least one closing valve is adapted to be operated at different time intervals.

21. Vacuum cleaning device according to claim 1, wherein the at least one filter is configured as a folded filter.

22. Vacuum cleaning device according to claim 1, wherein the at least one filter comprises a single filter.

23. Vacuum cleaning device according to claim 22, wherein the filter is adapted to be acted upon by external air over an entire surface of the filter by opening the closing valve.

24. Vacuum cleaning device according to claim 1, wherein the valve body, starting from the closed position, is adapted to be continuously moved back to the closed position via the open position.

25. Vacuum cleaning device according to claim 1, wherein the at least one filter is adapted to be acted upon by external air for less than 200 ms by means of the at least one closing valve.

26. Vacuum cleaning device according to claim 1, wherein the at least one filter is adapted to be acted upon by external air by means of the at least one closing valve while maintaining a negative pressure in a mouth region of a suction hose which opens into the suction inlet.

27. Vacuum cleaning device according to claim 26, wherein, when a 2.5 m-long suction hose with an inside diameter of 35 mm is connected while the at least one filter is acted upon by external air, a negative pressure in the suction hose at a distance of 3 cm from the suction inlet falls, at most for 150 ms, below 40% of a value which forms when closing valves are closed.

* * * * *